United States Patent [19]

Allen

[11] 3,991,580

[45] Nov. 16, 1976

[54] MINE ROOF SUPPORTS

[75] Inventor: Archelaius Dawson Allen, Leyland, England

[73] Assignee: Gullick Dobson Limited, Wigan, England

[22] Filed: Aug. 28, 1975

[21] Appl. No.: 608,675

[30] Foreign Application Priority Data

Nov. 15, 1974 United Kingdom ..... 49427/74

[52] U.S. Cl. ..... 61/45 D; 248/357

[51] Int. Cl.[2] ..... E21D 15/44

[58] Field of Search ..... 61/45 D; 248/357; 299/31, 33, 32; 91/170 MP

[56] References Cited

UNITED STATES PATENTS

| | | | |
|---|---|---|---|
| 3,192,721 | 7/1965 | Gaskell | 61/45 D |
| 3,355,898 | 12/1967 | Barrett et al. | 61/45 D |
| 3,418,814 | 12/1968 | Groetschel | 61/45 D |
| 3,525,227 | 8/1970 | Hancock et al. | 61/45 D |
| 3,851,480 | 12/1974 | Beulker et al. | 61/45 D |

FOREIGN PATENTS OR APPLICATIONS

| | | | |
|---|---|---|---|
| 2,025,138 | 2/1971 | Germany | 61/45 D |
| 1,266,707 | 4/1968 | Germany | 61/45 D |
| 1,902,042 | 8/1970 | Germany | 61/45 D |
| 1,251,968 | 11/1971 | United Kingdom | 61/45 D |

*Primary Examiner*—Dennis L. Taylor

*Attorney, Agent, or Firm*—Berman, Aisenberg & Platt

[57] ABSTRACT

A self-advancing mine roof support of which the ground-engaging structure comprises a pair of spaced apart skids in the spacing between which the relay bar structure of the advancing mechanism is housed, such structure being powered by a pair of pressure-fluid operated rams disposed one adjacent each of said two skids.

10 Claims, 6 Drawing Figures

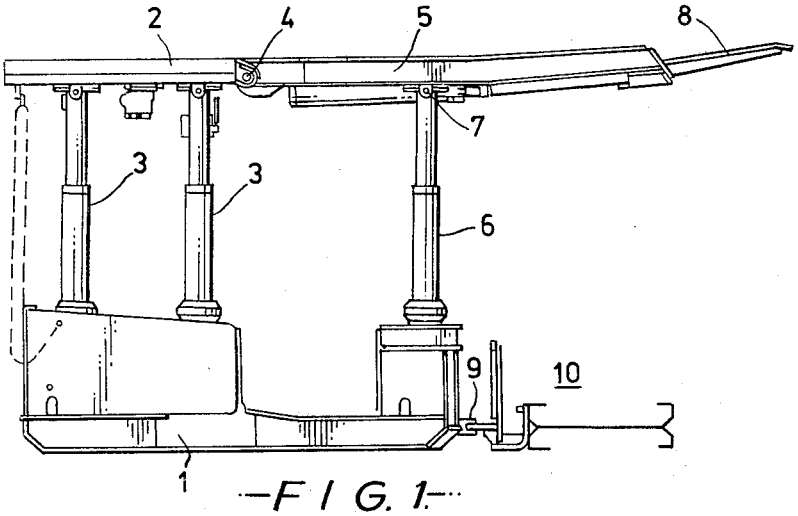
—FIG. 1—
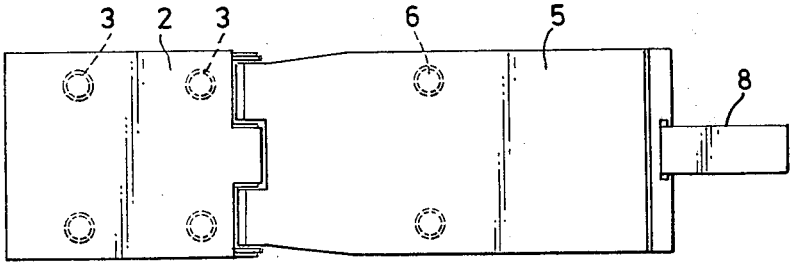
—FIG. 2—

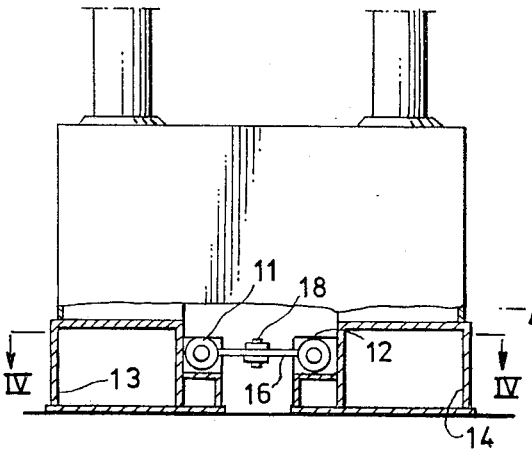
-FIG. 3.-
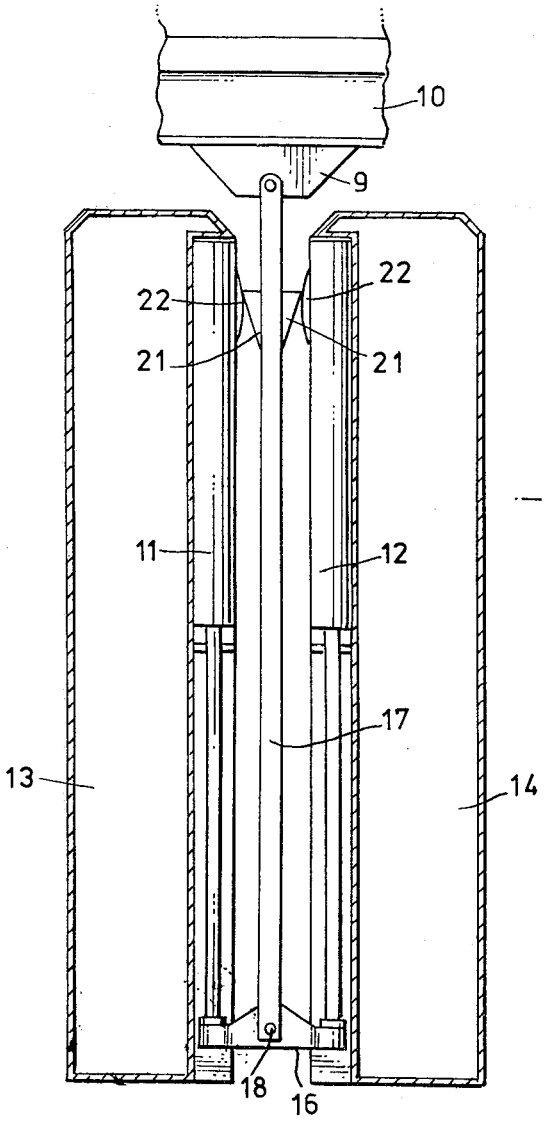
-FIG. 4.-

MINE ROOF SUPPORTS

The present invention relates to self-advancing mine roof supports and more particularly to the arrangements for advancing the supports.

Self-advancing mine roof supports normally consist of a base constituted by or supported on, a pair of spaced apart skids, a roof-engaging structure and pressure-fluid-operated means acting between the base and the roof-engaging structure to urge the latter into engagement with the mine roof. The advancing arrangements consist of pressure-fluid-operated means arranged to advance some form of anchorage means and then to draw the skids and thus the support towards the advanced anchorage means. Most often the anchorage means is a conveyor which upon operation of the advancing means is pushed ahead of the support while the latter is anchored by virtue of the engagement of the roof-engaging structure with the roof and the skids pressing on the floor, or by virtue of the support being coupled to an adjacent support similarly anchored, or both. When the conveyor has been thus advanced it is anchored in its new position, the roof-engaging structure of the support is released from engagement with the roof and the advancing means which earlier advanced the conveyor is operated in reverse to draw the support up to the anchored conveyor. Alternatively the support itself may have a forward part and a rearward part with the advancing means acting between the two parts each of which is separately anchorable by being jammed between the roof and floor by individual fluid-pressure operated means. In this case the forward part acts in the same manner as the conveyor in the arrangement described above.

The advancing means itself is usually a double-acting hydraulic ram arranged in the space between the two skids of the base and being extensible to advance the conveyor, or the forward part of the support, and retractable to draw the support up to the conveyor, or to draw the rearward part of the support up to the forward part. When such ram is attached between the support and conveyor, side loading in the direction of length of conveyor can be so great as to bend or damage the piston rod to render the ram inoperable. Often it is convenient to connect the piston rod directly to the conveyor and this results in large forces used for advancing the conveyor and small forces for advancing the support whereas the opposite is more suitable in practice.

It is the object of the invention to reduce the obstruction of the free space between the skids caused by the known arrangement of a single hydraulic ram disposed in such space and to this end the advancing means of the support in accordance with the invention comprises a pair of fluid-pressure operated ram devices each one disposed inside or adjacent a different one of the two skids and both being coupled at one end to a relay bar structure acting within such space.

The relay bar may be a single centrally disposed solid or prefabricated bar connected to the rams by a cross member or it may be of a U-configuration so that its limbs lie along the inner sides of the skids and the base of the U constitutes a cross member linking the two limbs.

The connection between the relay bar and the rams and between the bar and the anchorage means preferably are such as to introduce a significant degree of flexibility and in the case of the single centrally disposed bar locating flights are provided towards its free end to centralise the bar between the skids when the rams are extended and thus position the support relative to the conveyor. When the flighted part of the bar lies outside the gap between the skids it has no centralising effect and thus permits relative snaking movement between the conveyor or other anchorage means and the support.

The various features and advantages of the invention will be apparent from the following description of two embodiments of the invention taken in conjunction with the accompanying drawings.

In the drawings:

FIG. 1 is a side elevation of a six leg roof support embodying the invention,

FIG. 2 is a plan view of the support of FIG. 1,

FIG. 3 is a rear end view, partly broken away, of the lower portion of one form of the support of FIG. 1, FIG. 4 is a longitudinal section on the line IV—IV of FIG. 3, FIGS. 5 and 6 are views similar to those of FIGS. 3 and 4 of a second form of the support of FIG. 1 the section of FIG. 6 being on the line VI—VI of FIG. 5.

Figure 5:
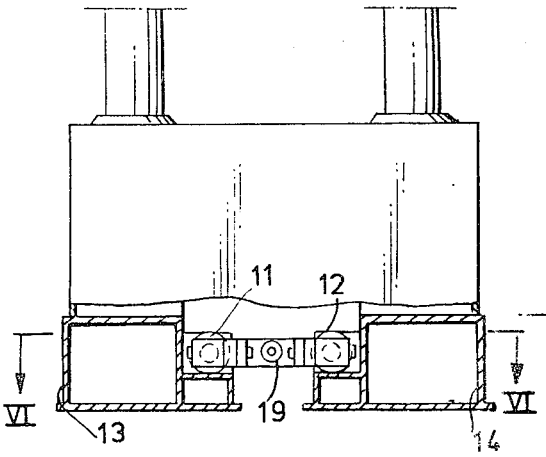

Referring first to FIGS. 1 and 2 the roof support shown in these figures is largely of conventional form and consists of a base or ground-engaging structure 1 from which a canopy 2 is supported by four hydraulically extensible legs 3. Hinged at 4 to the forward end of the canopy 2 is a roof bar 5 the angular disposition of which is adjustable by means of a further pair of hydraulically extensible legs 6 pivotally attached at 7 to roof bars 5 and mounted on the forward end of base structure 1. An extension roof bar 8 is retractably arranged in the forward end of roof bar 5 and a clevis 9 serves for the attachment of the base structure 1 to a conveyor indicated at 10. Referring now to FIGS. 3 and 4 a first form of the self-advancing arrangements of the support comprises a pair of hydraulic rams 11 and 12 mounted on the inner faces of a pair of spaced apart skids 13 and 14 forming part of the base structure 1 of the support. The free ends of the pistons of the rams 11 and 12 are interconnected by a cross member 16 to the centre of which a relay bar 17 is coupled by means of a flexible joint 18. The bar 17 extends between the rams 11 and 12 and is formed or provided at its opposite end with a clevis 9 by means of which it can be attached to the conveyor 10. Towards such free end the bar 17 has locating flights 21 which, in the extended state of the rams 11 and 12 shown in the drawing, co-operate with formation 22 on the inner faces of the skids 13 and 14 to centralise the bar 17 between the skids. As the rams 11 and 12 are extended this cooperation progressively increases and a degree of sideways movement of the bar is limited thus locating the support relative to the conveyor at the completion of its advance. The relay bar 17 itself may be a spring steel bar affording a degree of flexibility or it may be channel or box section fabricated bar affording a lesser degree of flexibility. The flexiblity afforded by the nature of the bar may be supplemented for the entire system by the nature of the attachment of the conveyor 10 to the bar 17 of the bar 17 to the cross member 16, and of the cross member 16 to the pistons of the rams 11 and 12.

Figure 6:
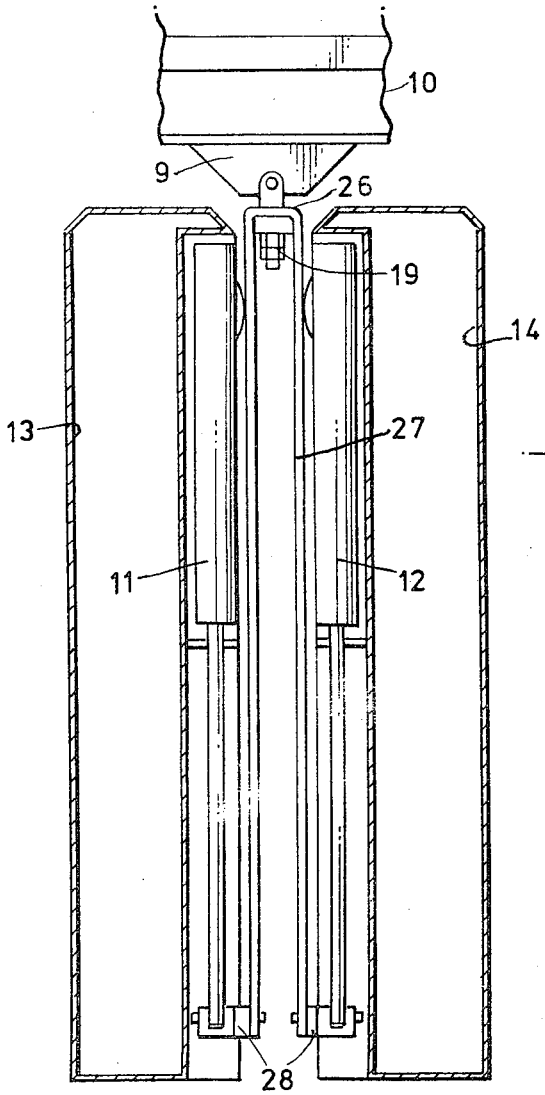

In the alternative form of advancing means shown in FIGS. 5 and 6, the rams 11 and 12 are connected at the free ends of their pistons to the free ends of the limbs of a relay bar 27 of U-configuration. The connection is, in each case, by means of a vertical hinge 28 and the limbs of the bar lie alongside the inner faces of the skids 13 and 14 leaving an unobstructed space between them. The base of the U-configuration of bar 27 forms a cross member 26 to which the clevis 9 is attached by an adjustable attachment 19 such that clevis 9 can be adjusted to project to varying extents from the cross member 26 to engage the conveyor 10. Alternatively the clevis 9 may be secured to the cross member in fixed manner and the cross member itself instead of extending at right angles to the limbs of the bar 27 may be of V-shape. In this alternative form the relay bar 27 is preferably formed of spring steel to provide the necessary flexibility to the arrangement. The open ends of the U-configuration may be closed slightly so that the location of relay bar and support takes place when the support is near the conveyor.

I claim:

1. A self-advancing mine roof support comprising a roof-engaging structure, a ground-engaging structure, hydraulically extensible means arranged between said floor-engaging and roof-engaging structures and operable to adjust the position of said roof-engaging structure relative to said ground-engaging structure, and advancing means operable to advance said support relative to an anchorage means, wherein said ground-engaging structure comprises a pair of longitudinally extending laterally spaced skids and said advancing means comprises a pair of pressure-fluid-operated ram devices each located adjacent one of said skids and both connected rearwardly of their lengths to a relay bar structure extending along the space between said skids.

2. A support as claimed in claim 1 wherein said bar structure is of resilient form.

3. A support as claimed in claim 2 wherein said bar structure is of spring material.

4. A support as claimed in claim 1 wherein said bar structure incorporates centralising guide means arranged to co-operate with the inward facing sides of said skids, or formations thereon, to guide said bar structure over at least part of its movement relative to said skids.

5. A support as claimed in claim 4 wherein said bar structure comprises a single centrally disposed bar having flights or guide members on opposite sides thereof toward one end to serve as said centralising guide means.

6. A support as claimed in claim 5 wherein said bar is flexibly jointed at one end thereof to a cross member of which opposite ends are respectively connected to different ones of said ram devices.

7. A support as claimed in claim 4 wherein said bar structure comprises a pair of spaced limbs joined at one end to form a U-shape and hingedly attached at their other ends each to one of said ram devices said limbs serving also as said centralising guide means.

8. A support as claimed in claim 1 wherein the end of the relay bar structure remote from the coupling with said ram devices carries a clevis adjustable in position longitudinally of the relay bar structure.

9. A support as claimed in claim 1 wherein said relay bar structure comprises an elongated relay bar disposed substantially parallel to the longitudinal axes of each of said ram devices. wherein

10. A support as claimed in claim 1 wherein said relay bar structure comprises an elongated U-shaped member disposed substantially parallel to the longitudinal axes of each of said ram devices and connected at the free ends thereof to the rearwardly extending piston ends of said ram devices.

* * * * *